US008858243B2

(12) United States Patent
Luo et al.

(10) Patent No.: US 8,858,243 B2
(45) Date of Patent: Oct. 14, 2014

(54) ELECTRICAL CONNECTOR WITH GROUNDING BAR TO REDUCE CROSS TALKING

(71) Applicants: Yu Luo, Shenzhen (CN); Hong-Jing Luo, Shenzhen (CN); Xing-Liang Liu, Shenzhen (CN)

(72) Inventors: Yu Luo, Shenzhen (CN); Hong-Jing Luo, Shenzhen (CN); Xing-Liang Liu, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 120 days.

(21) Appl. No.: 13/713,004

(22) Filed: Dec. 13, 2012

(65) Prior Publication Data

US 2013/0149882 A1 Jun. 13, 2013

(30) Foreign Application Priority Data

Dec. 13, 2011 (CN) ..... 2011 1 0413971

(51) Int. Cl.

| | |
|---|---|
| ***H01R 13/648*** | (2006.01) |
| ***H01R 13/652*** | (2006.01) |
| ***H01R 13/6471*** | (2011.01) |
| ***H01R 31/08*** | (2006.01) |

(52) U.S. Cl.

CPC ..... *H01R 13/652* (2013.01); *H01R 13/6471* (2013.01); *H01R 31/08* (2013.01)

USPC ..... 439/108; 439/607.05

(58) Field of Classification Search

USPC ..... 439/108, 607.5, 607.8, 660, 79

See application file for complete search history.

(56) References Cited

U.S. PATENT DOCUMENTS

| | | | | |
|---|---|---|---|---|
| 5,993,263 | A * | 11/1999 | Sampson | 439/660 |
| 7,320,623 | B2 * | 1/2008 | Hisamatsu et al. | 439/637 |
| 8,221,139 | B2 | 7/2012 | Qin et al. | |
| 8,342,886 | B2 * | 1/2013 | Zhang et al. | 439/660 |
| 8,702,451 | B2 * | 4/2014 | Luo et al. | 439/607.28 |
| 2009/0221165 | A1 | 9/2009 | Buck et al. | |

* cited by examiner

*Primary Examiner* — Xuong Chung Trans

(74) *Attorney, Agent, or Firm* — Wei Te Chung; Ming Chieh Chang

(57) ABSTRACT

An electrical connector includes a housing including a base portion and a tongue portion and contacts. The contacts include contacting plate at the tongue portion, leg portion extending from the rear and retaining portions retained in the base portion. The contacts includes a first group and second group, each group including ground contacts and signal contacts. The contacting plates of the first group are located along a first side face of the tongue portion, the contacting plate of the second group are located along an opposite second side face, the retaining portions of the first and second groups being spaced from each other. A one-piece grounding bar is retained in the base portion, the ground bar includes a beam portion hidden in the base portion and between said retaining portions of the first group and second groups, and fingers touch with corresponding retaining portions of ground contacts.

15 Claims, 8 Drawing Sheets

FIG. 2

ELECTRICAL CONNECTOR WITH GROUNDING BAR TO REDUCE CROSS TALKING

BACKGROUND OF THE INVENTION

1. Field of the Invention

The present invention generally relates to an electrical connector, and more particularly to an electrical connector capable of high speed and backwards compatibility with relative lower high speed.

2. Description of Related Art

Serial Attached SCSI (SAS) is a successor to the parallel SCSI and is also based on serial technology. Besides the advantage of higher speed signal transmission, another most significant advantage is that the SAS interface will also be compatible with SATA drives. In other words, the SATA plug connector can plug directly into a SAS receptacle connector if supported in the system. By this way, the system builders are flexible to integrate either SAS or SATA devices and slash the costs associated with supporting two separate interfaces.

U.S. Pat. No. 6,942,524 discloses a SAS connector for SAS 2.0 standard transmitting 6.0 Gbps. Higher signal transmission is a tendency in high speed industry. Connectors adapted for speed higher than 6.0 Gbps is developing. Questions of electrical performance, such as cross talk, signal attenuation arises. Particularly, crosstalk is a major issue at 12 Gbps. So, we hope design an electrical connector to overcome said question.

SUMMARY OF THE INVENTION

Accordingly, an object of the present invention is to provide electrical connectors capable to 12 Gbps.

In order to achieve the object set forth, an electrical connector comprises a housing defining a front and a rear. The housing comprises a base portion and a tongue portion from a front face of the base portion, the tongue portion defines a first side face and a second side face opposite to the first side face, the second side face defines a rib with a third side face. A first group of contacts are held in the first side face, the first group of contacts comprising group contacts and signal contacts. A second group of contacts are held in the second side face. The second group of contacts comprises group contacts and signal contacts. A third group of contacts are held at the third side face. Said three groups of contacts comprises contacting plates located in the tongue portion, leg portions extending from the rear of the housing and a retaining portion retained in the base portion of the housing. A one-piece grounding bar is retained in the base portion. The ground bar defines first fingers extending to touch with the retaining portions of all ground contacts of the first group of contacts and a second fingers extending to touch with retaining portions of all ground contacts of the second group of contacts.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Referring to FIGS. 1 through FIG. 8, an electrical connector 100 is provided an interface for a high speed storage device, especially for SAS signal transmission which is capable to 12 Gbps operation.

Figure 1:
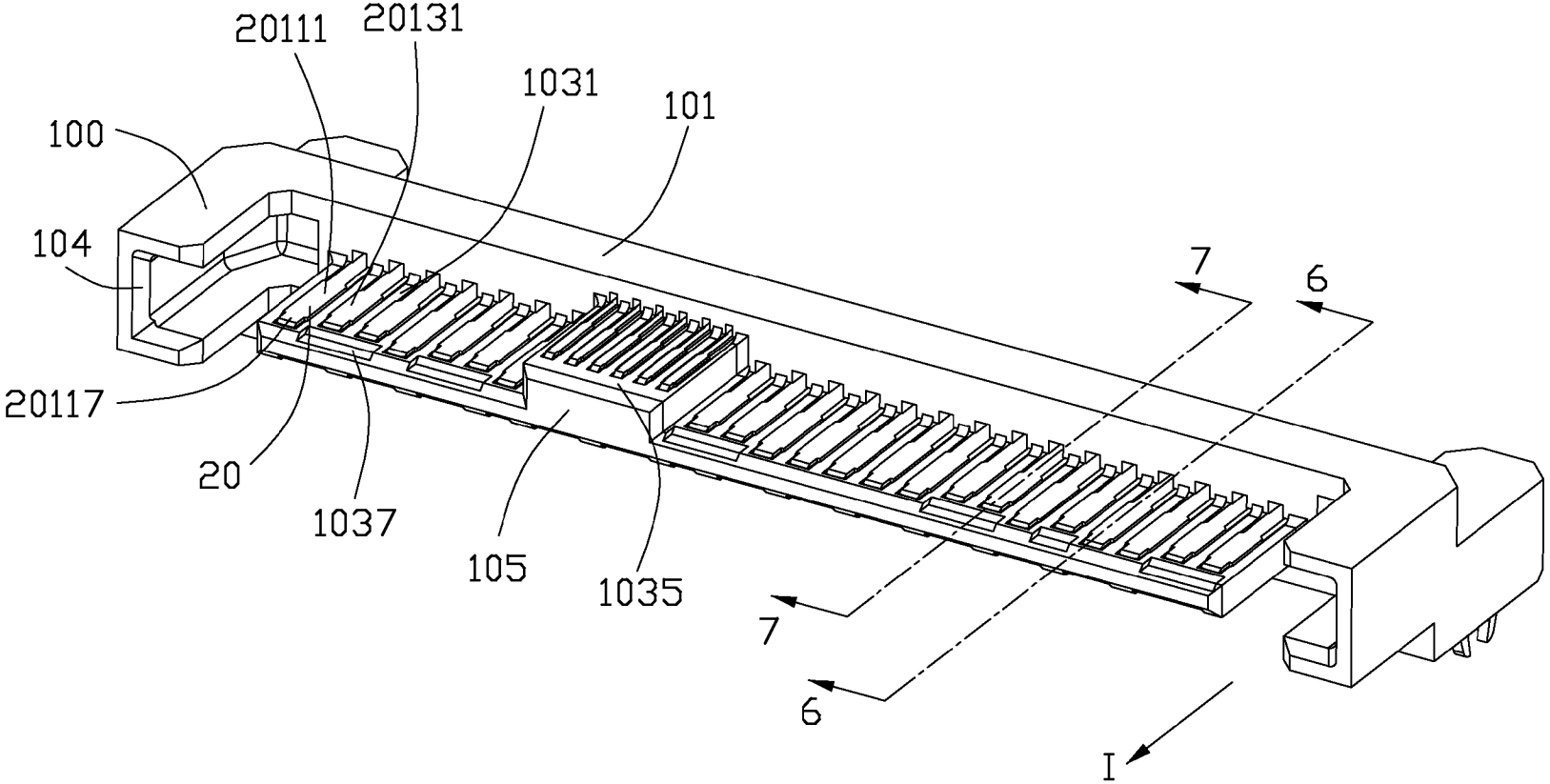
FIG. 1 is a perspective view of an electrical connector in accordance with the present invention.
Figure 2:
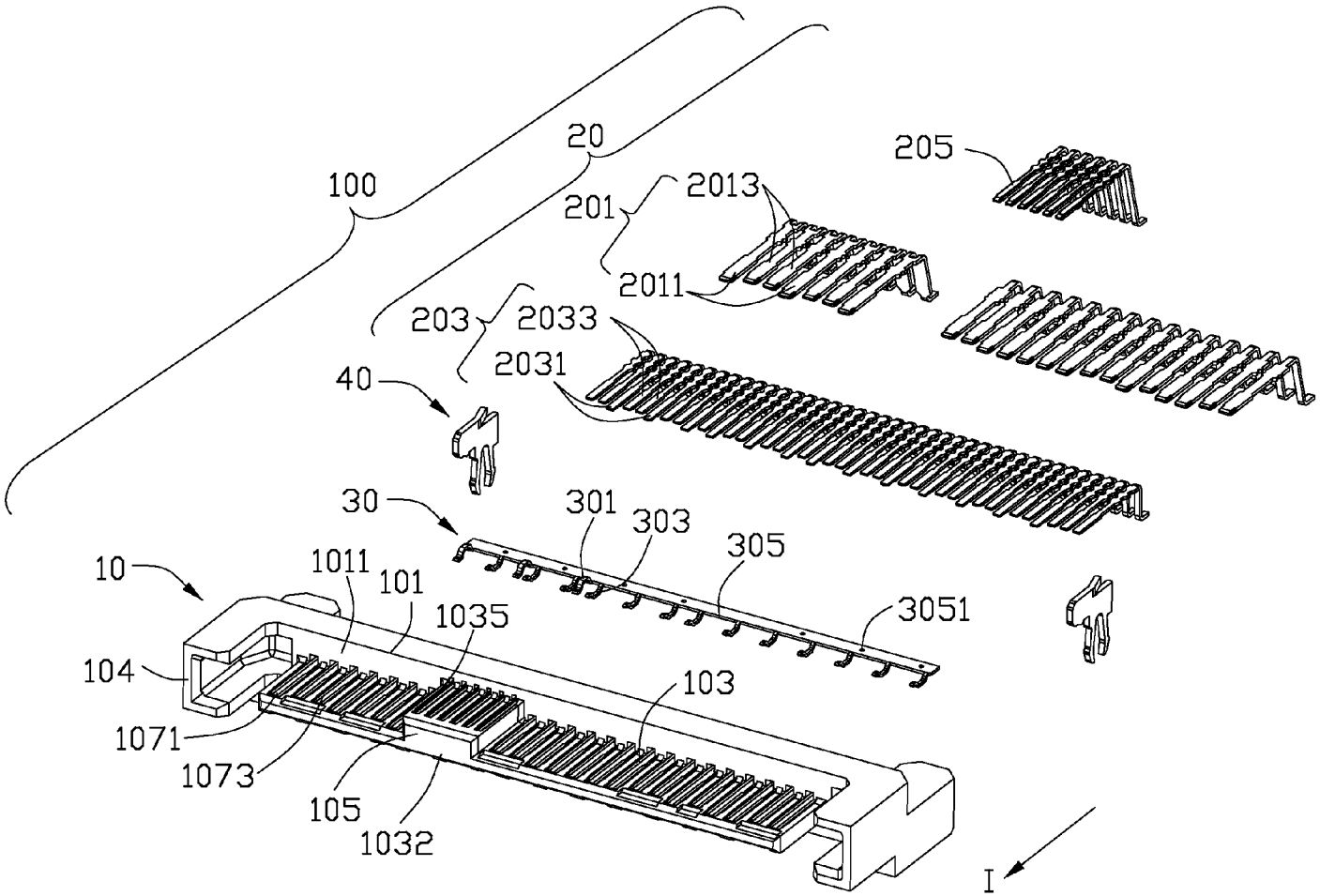
FIG. 2 is an exploded perspective view of the electrical connector shown in FIG. 1.
Figure 3:
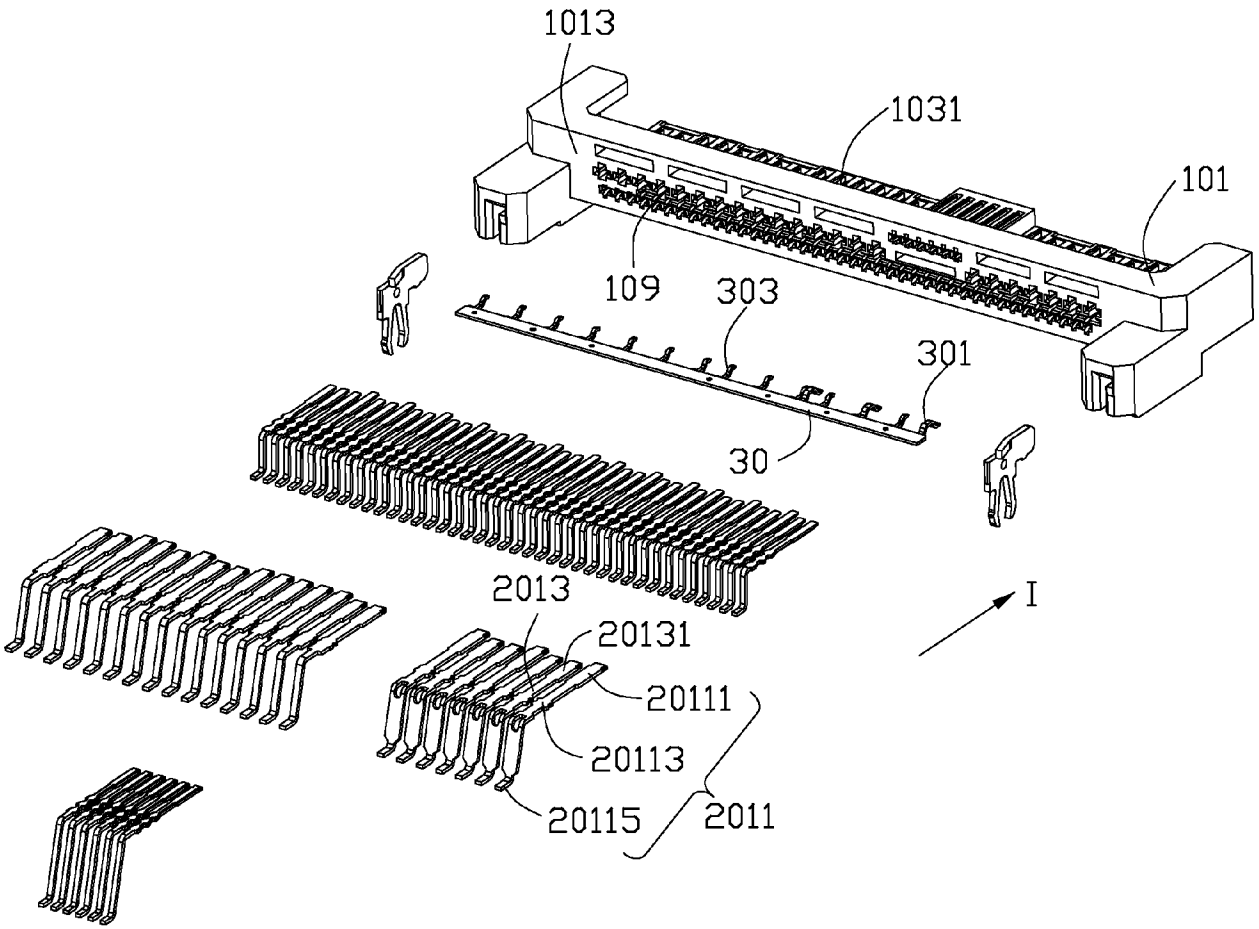
FIG. 3 is an exploded perspective view of the electrical connector shown in FIG. 1.
Figure 4:
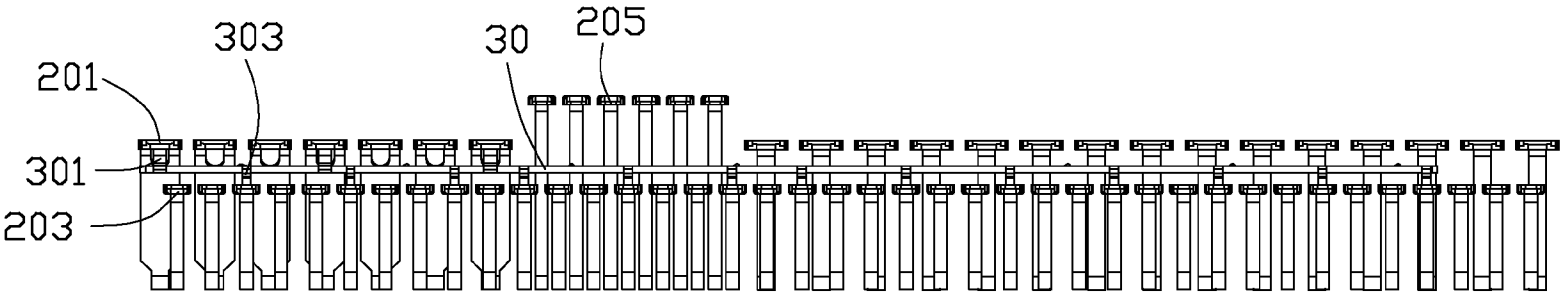
FIG. 4 is a top plan view of contacts.
Figure 5:
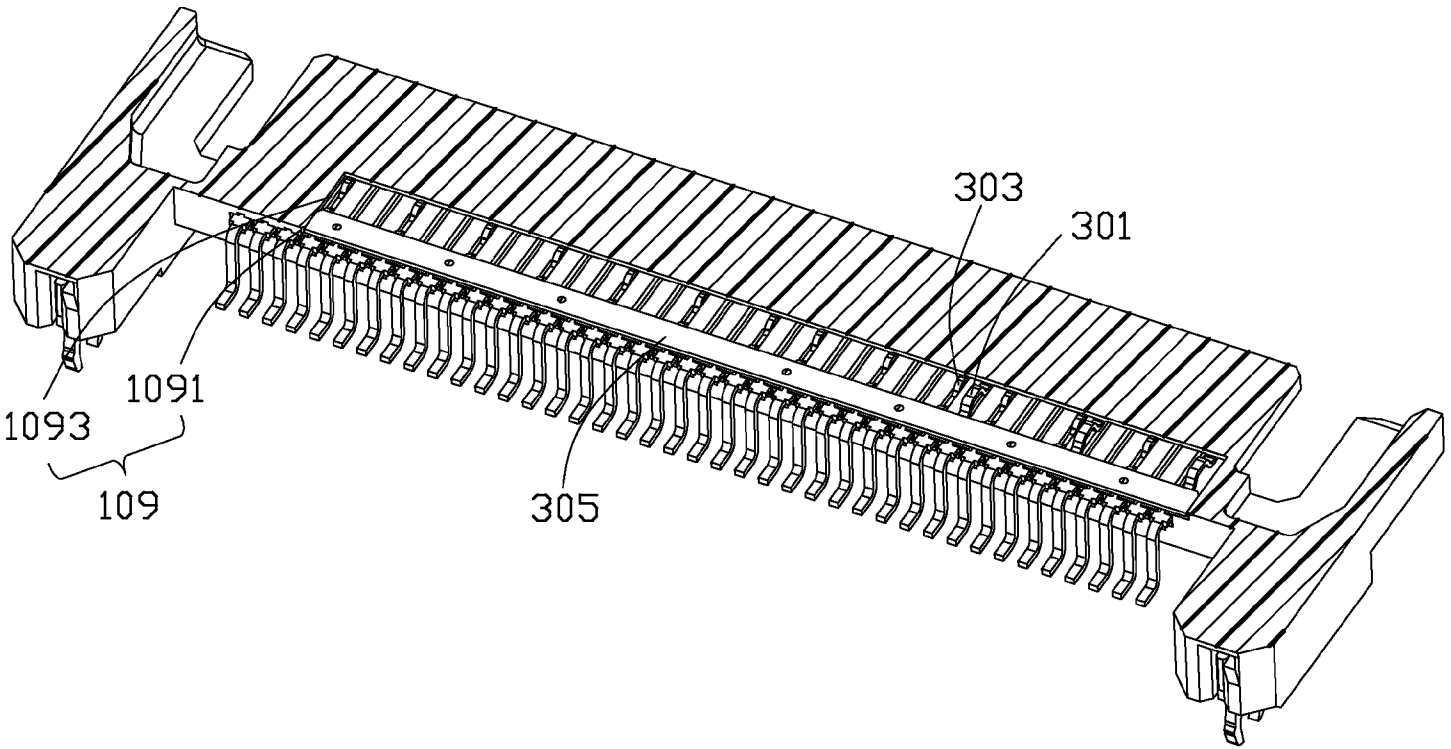
FIG. 5 is a perspective view of part of electrical connector.
Figure 6:
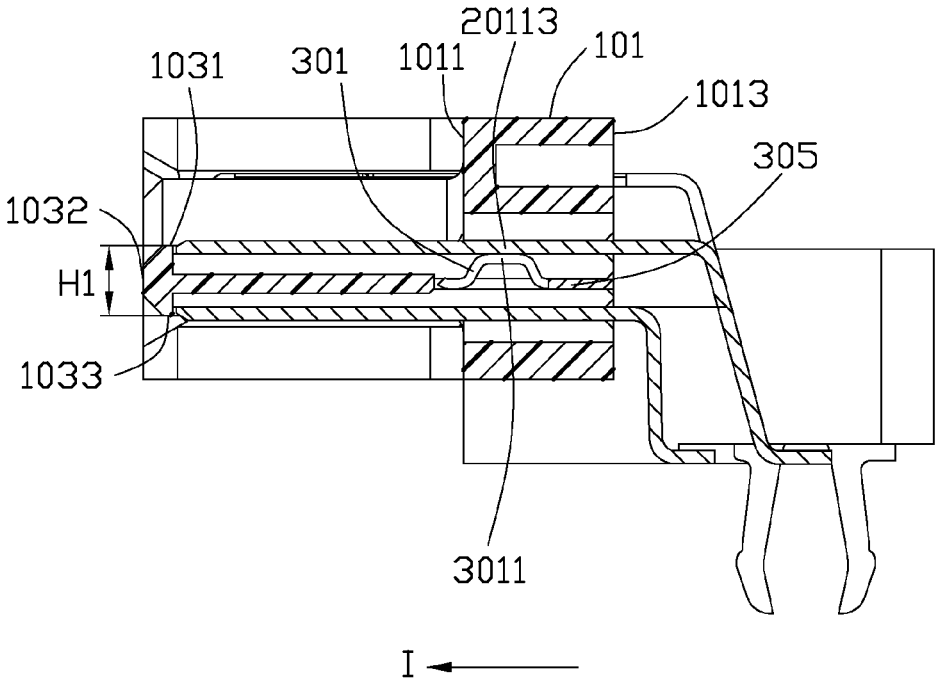
FIG. 6 is a cross-section view of the electrical connector taken along lines 6-6 in FIG. 1.
Figure 7:
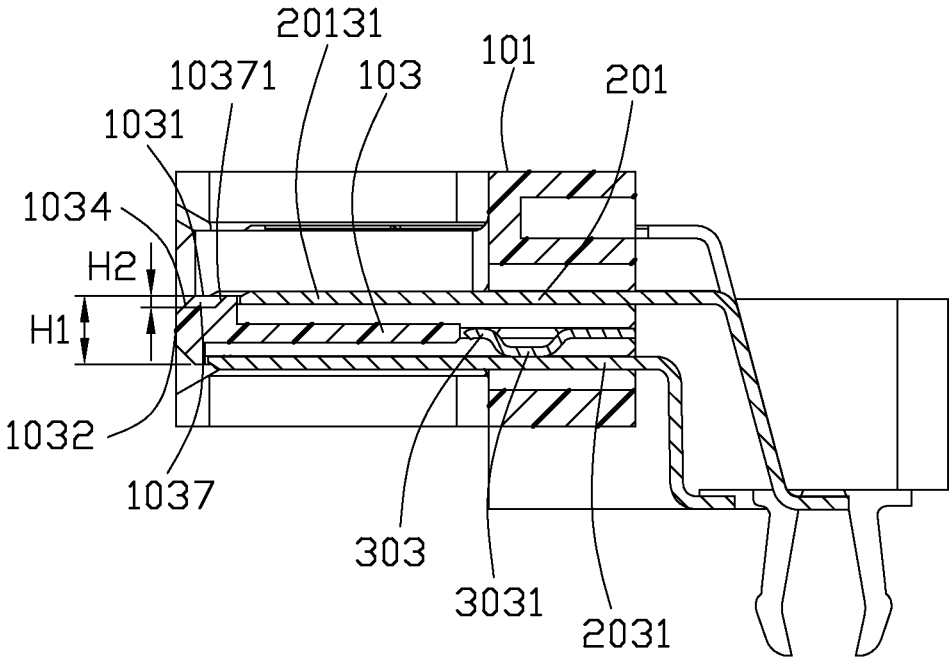
FIG. 7 is a cross-section view of the electrical connector taken along lines 7-7 in FIG. 1.

Referring to FIGS. 2 and 3, the electrical connector 100 intending to be mounted on a circuit board (not shown) and mated with a complementary connector, includes an housing 10 made from insulating material, a plurality of conductive contacts 20 held in the corresponding passageways of the housing and a pair of board-lock members 40 for retaining the connector on the circuit board. The housing 10 defines a front and a rear and includes a longitudinal base portion 101 with a front face 1011 and a rear face 1013, a tongue portion 103 extending forwards from the front face 1011 of the base portion with a first height H1 (labeled in FIG. 6) and a pair of U-shape guiding portions 104 separately located at opposite ends of the tongue portion 103. The tongue portion 103 defines a front face 1032 perpendicular to an extending direction I thereof, which is functioned as a welcome face. The tongue portion 103 defines a first side faces 1031 and a second side face 1033 labeled in FIG. 6 opposite to the first side face, between which the front face 1032 is located. The side faces 1031, 1033 are parallel to the extending direction I and a longitudinal direction. The tongue portion 103 further defines a rib 105 at the first side face 1031, thereby forming a third side face 1035 at the same side of and parallel to the first side face 1031. The first, second and third side faces 1031, 1032, 1035 are parallel to each other.

The contacts 20 comprises three groups 201, 203, 205 of contacts 20. The first group 201 of contacts is disposed at the first side face 1031, the second group of contacts 203 at the second side face 1033 and the third group 205 of contacts is at the third side face 1035. The first group 201 of contacts at least comprises two first ground contacts 2011 and at least one signal contact 2013 between said two first ground contacts 20 11 arranged along the first side face 1031. The second group 203 of contacts at least comprises two first ground contacts 2031 and at least one signal contact 2033 between said two second ground contacts arranged along the second side face 1033. In this embodiment, the at least one first/second signal contact is construed with a differential signal pair, i.e. two signal contacts 2013/2031. The first and second groups of contacts are arranged in a ground-signal-signal-ground pattern. While the electrical connector is illustrated and described as being a right angle electrical connector, it is realized that the electrical connector may have another configurations in alternative embodiments. For example, the connector may be a vertical connector.

The housing 10 defines first grooves 1071 receiving the first ground contacts 2011 and second grooves 1073 receiving the first signal contacts 2013. Combination with FIG. 5, the housing defines a longitudinal un-interrupted slot 109 from the rear face 1013 through the front face 1011, the slot 109 is parallel located between the first side face 1031 and the second side face 1033. The slot 109 includes a longitudinal continuous part 1091 extending along a longitudinal direction of the base portion and a plurality of partition part 1093 parallel extending along the extending direction I. The partition slots 1093 are aligned with the first and second grooves 1071, 1073 one by one. A one-piece ground bar 30 is disposed in the slot 109 to connect with said all ground contacts of the first group and second group of the contacts 20. The ground bar 30 includes a beam portion 305 and a plurality of first spring fingers 301 touching with the first ground contacts and a plurality of second spring fingers 303 touching with all ground contacts of the second group 203 of the contacts. The first and second fingers 301, 303 extend from a front edge of the beam bar 30. The first fingers 301 bend downward and the second fingers 303 bend upwards, each of which has a flat contacting section 3011. The ground bar 30 is assumed in the slot from a rear face of the base portion, e.g., the beam portions 305 are located near to the rear of the housing. The beam portion 305 defines a plurality of bumps 3051 downwards and upwards, which are fitly interfered with the slots 109. Combination with FIG. 4, the grounding bar 30 integrally connects with all ground contacts, not only decrease cross-talks between the signal contacts but also increase resonance frequency of the electrical connector 100. The whole grounding bar 30 are received in the base portion 101 of the housing to enlarge intensity of the housing.

The first group 201 of contacts includes first ground contacts and first signal contacts, the second contacts and the first contacts 205 have similar shape. The first contacts are described hereafter. Combination with FIGS. 3, 5 and 7, the first grounding contact 2011 includes first contacting plate 20111 located at the first side face 1031 of the tongue portion 103, and retaining portion 20113 with barbs interfered with housing 10 and soldering portion 20115 extending from the rear of the housing. The contact plates 20111 extend in the extending direction I and are arranged along the longitudinal direction perpendicular to the extending direction I. The distal ends of the first fingers 301 extend and elastically touch with the retaining portion 20113 of the ground contacts. Since the retaining portions 20113 have a large dimension than the contacting plate and the leg portions, engagement of the retaining portions and the fingers is better. Similarly, the first signal contacts include second contacting plate 20131 on the first side face 1031 of the tongue portion. The distal ends of the second fingers 303 extend to the second side face 1033 and touch with the retaining portions of the second ground contacts. The first contacting plate and the second contacting plate extend along the extending direction I. The first and second fingers not only connect the first ground contacts together, but also connect with the first ground contacts and the second ground contacts together. The first and second fingers 301, 303 define first contacting plane 2031 and second contacting plane 3031 which will enlarger contacting area. Said two contact planes have a larger distance therebetween, which means said contacting planes is interfered with a thicker insulating housing.

Figure 8:
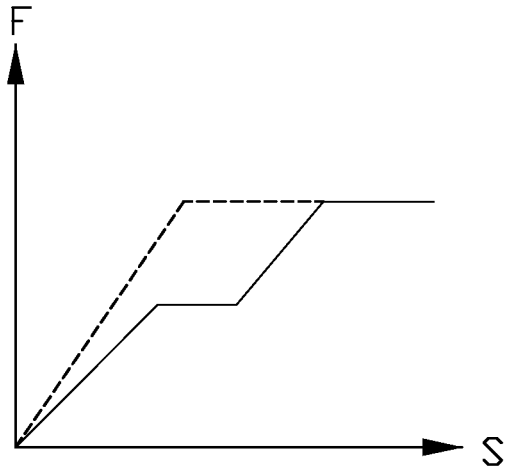
FIG. 8 is a chart comparing rising rates of inserted forces.

The first contacting plate 20111 have a front end 20117 projecting forwards and nearer to the front or welcome face 2031 of the tongue portion. The second contacting plate 20131 are aligned with a recesses 1037 defined at the front portion of the tongue portion 103. The recess 1037 has a height H2, which is designed to avoid insertion interfere of the complementary connector into the electrical connector. The recess 1037 defined a guiding face 10371 oriented to the extending direction and a fourth side face 1034 between the welcome face 1032 and the first side face 1031 so that the guiding face 10371 is parallel to the fourth side face 1034 and angled with the first side face with an angle of 45 degree. The recess 1037 runs through the front face 2031. FIG. 8 illustrates the rise rates of inserted forces F exerted on the electrical connector when the complementary connector is inserted into the electrical connector. The broken lines shows the rise rate of the inserted force F of a conventional connector without any recess 1037, wherein the inserted force arrive the peak quickly guided by a conventional guiding face, resulting a breakage to the tongue portion or the contacts of the conventional connector. The continuous line show the rise rate of the inserted force F when the recess 1037 is disposed on the tongue portion 103. When the complementary connector arrives at the recess 1037, the inserted force keeps in a middle numerical. Then the complementary connector is guided to move further by the guiding face 10371. The tongue portion 103 and the contacts 20 touch with the complementary connector in sequence, thereby reducing a crushed risk of the contacts 20 since slow the rise rate of the insertion force F.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

a housing defining a front and a rear, the housing comprising a base portion and a tongue portion from a front face of the base portion, the tongue portion defining a first side face and a second side face opposite to the first side face, the second side face defining a rib with a third side face;

a first group of contacts held in the first side face, the first group of contacts comprising group contacts and signal contacts;

a second group of contacts held in the second side face, the second group of contacts comprising group contacts and signal contacts;

a third group of contacts held at the third side face;

said three groups of contacts comprising contacting plates located in the tongue portion, leg portions extending from the rear of the housing and a retaining portion retained in the base portion of the housing;

a one-piece grounding bar retained in the base portion; wherein the ground bar defines first fingers extending to touch with the retaining portions of all ground contacts of the first group of contacts and a second fingers extending to touch with retaining portions of all ground contacts of the second group of contacts.

2. The electrical connector as claimed in claim 1, wherein the grounding bar is located between the first group and second group of contacts, the grounding bar comprising a beam portion, and the first and second fingers extend from a front edge of the beam portion.

3. The electrical connector as claimed in claim 2, wherein the beam portion is disposed parallel to the first and second side faces.

4. The electrical connector as claimed in claim 1, wherein the first and second fingers comprise flat apexes pressing against the retaining portions of the ground contacts.

5. The electrical connector as claimed in claim 4, wherein the flat apexes are located behind the front face of the base portion.

6. The electrical connector as claimed in claim 5, wherein distal ends of the first and second fingers extends forwards from the front face of the base portion.

7. The electrical connector as claimed in claim 5, wherein the tongue portion defines recesses at a front end thereof, the recesses correspond to the signal contacts of the first and second groups of the contacts.

8. An electrical connector comprising:

a housing defining a front and a rear, the housing comprising a base portion and a tongue portion from a front face of the base portion, the tongue portion defining a first side face and a second side face opposite to the first side face;

a plurality of contacts comprising contacting plate at the tongue portion, leg portion extending from the rear and retaining portions retained in the base portion;

the plurality of contacts includes a first group and second group, each group comprising ground contacts and signal contacts, the contacting plates of the first group are located along the first side face, the contacting plate of the second group are located along the second side face, the retaining portions of the first and second groups being spaced from each other;

a one-piece grounding bar retained in the base portion;

wherein the ground bar comprising a beam portion hidden in the base portion and between said retaining portions of the first group and second groups, and fingers touch with corresponding retaining portions of ground contacts of the first and second group of contacts.

9. The electrical connector as claimed in claim 8, wherein the base portion defines a plurality of passageways to receive the retaining portions of the contacts under condition that the retaining portion is spaced from corresponding interior faces of the corresponding passageway both upwardly and downwardly in a vertical direction so as to make the retaining portion more compliant with the corresponding finger when the finger of the ground bar resiliently abuts against one face of the retaining portion.

10. The electrical connector as claimed in claim 9, wherein a cross-section of the corresponding passageway receiving the retaining portion of the ground contact defines a narrowed region to compliantly receive the corresponding finger of the ground bar.

11. An electrical connector for use with a complementary connector, comprising:

an insulative housing defining a base portion, and a tongue portion forwardly extending from the base portion and defining opposite first and second mating surfaces;

a plurality of contact receiving passageways defined in the housing along a front-to-back direction and arranged in upper and lower rows; a plurality of contacts received in the contact receiving passageways, respectively, each of said contacts including a front planar contacting section disposed upon the corresponding mating face and a rear retaining section disposed in the base portion; and a ground bar disposed in the base portion with a plurality of fingers selectively contacting corresponding grounding contacts, respectively;

wherein front ends of some of the contacting sections are rearwardly offset from those of others in a front-to-back direction, and a front edge region of the tongue portion defines a plurality of recessed areas in front of said front ends of said some of the contacting sections to lower insertion force for balancing consideration during mating with said complementary connector;

wherein the fingers abut against the retaining sections of the corresponding grounding contacts.

12. The electrical connector as claimed in claim 11, wherein the planar contacting section is mated with a corresponding deflectable mating contact in an abutment direction which is perpendicular to said front-to-back direction under a condition that the planar contacting section is spaced from an interior face of the corresponding contact receiving passageway in said mating direction so as to have said contacting section more compliant during mating.

13. The electrical connector as claimed in claim 11, wherein in the tongue portion, the recessed areas are not formed in front of the front ends of said others but only with a minor chamfered structure located in front of the front ends of said others.

14. The electrical connector as claimed in claim 11, wherein said retaining sections is spaced from interior faces of the corresponding contact receiving passageways upwardly and downwardly in a vertical direction so as to be compliant with the corresponding finger in an abutment direction which is perpendicular to the front-to-back direction.

15. The electrical connector as claimed in claim 14, wherein the contact in the corresponding contact receiving passageway is essentially in a pseudo-deflection manner via not only the contacting section experiencing an inward force due to mating with the complementary connector in the abutment direction but also the retaining section experiencing an outward force due to abutment with the finger in the abutment direction.

* * * * *